United States Patent [19]

Jackson et al.

[11] 4,361,208

[45] Nov. 30, 1982

[54] MODULAR ELEVATOR CAR

[75] Inventors: Leigh F. Jackson, Guilford Township, Franklin County; George A. Kappenhagen, Stroud Township, Monroe County, both of Pa.

[73] Assignee: Westinghouse Electric Corp., Pittsburgh, Pa.

[21] Appl. No.: 219,206

[22] Filed: Dec. 22, 1980

[51] Int. Cl.[3] ..... B66B 9/00

[52] U.S. Cl. ..... 187/1 R; 187/17; 52/30

[58] Field of Search ..... 187/1 R, 95, 17; 182/141, 102, 124; 211/168, 170; 52/30

[56] References Cited

U.S. PATENT DOCUMENTS

| | | | |
|---|---|---|---|
| 1,035,770 | 8/1912 | Blair | 182/124 |
| 3,043,397 | 7/1962 | Tillotson | 182/124 |
| 3,741,351 | 6/1973 | Suozzo | 187/1 R |
| 3,954,157 | 5/1976 | Atkey | 187/17 |

*Primary Examiner*—Joseph J. Rolla
*Assistant Examiner*—Kenneth Noland
*Attorney, Agent, or Firm*—D. R. Lackey

[57] ABSTRACT

An elevator car having a car frame and a composite platform. The composite platform has a first section defined by a beam member of the car frame, and a second section which is pivotally fastened to the car frame. The second section is pivotable between a shipping position, wherein the second section is substantially perpendicular to the first section, and an operating position wherein the first and second platform sections cooperatively define the platform assembly of the elevator car.

8 Claims, 2 Drawing Figures

MODULAR ELEVATOR CAR

BACKGROUND OF THE INVENTION

1. Field of the Invention

The invention relates in general to elevator cars, and more specifically to a modular elevator car especially suitable for hydraulic elevator systems.

2. Description of the Prior Art

The various components of an elevator system are conventionally shipped to the job site and assembled, including the components of the elevator car. Thus, the field assembly time, and therefore cost, is a substantial portion of the overall system cost. Certain types of elevator systems are required in relatively low-rise structures having only a few floors, for use primarily by the handicapped. The portion of the total building cost of such a structure attributable to the elevators is thus relatively large, and it would be desirable to reduce the manufacturing and field installation cost of elevators suitable for low-rise structures.

SUMMARY OF THE INVENTION

Briefly, the present invention is a new and improved modular elevator car which enables the car frame or sling and platform, as well as the car-mounted operational controls, to be completely assembled and wired at the factory. The car frame is a vertically oriented structural steel assembly disposed at the extreme front of the elevator car, with sufficient front-to-back depth to enable all car-mounted operational controls to be supported by, and protected by, the car frame. The operational controls are disposed on a selected portion of the bottom beam portion of the car frame, with the remaining portion of the bottom beam defining an entranceway, and thus the car frame provides an operative first portion or section of the platform. The bottom beam additionally includes a horizontally oriented flange for supporting the threshold plate for the entranceway. The remaining or second portion or section of the platform is pivotally mounted to the car frame with suitable pivot assemblies and selectively collapsible braces, which enables the second platform section to be assembled to the sling at the factory and pivoted upwardly into a vertically oriented shipping position. The shipping position of the second platform assembly additionally protects the sling-mounted operational controls from damage during shipment. The car door, car door operator, hydraulic jack, buffers, footing channels, guide roller assemblies, and sections of the guide rails, are also assembled with the car sling and made part of the shipping package. The hatch door and hatch door front for the lowest floor may also be conveniently incorporated into the shipping package, if desired. At the job site, the modular elevator package is placed in the elevator hatch pit, the guide rail sections shipped as part of the package are connected to the building, the cylinder portion of the hydraulic jack is connected to the building, and the second portion of the platform is unfolded or pivoted to its operative position. The braces are extended, locked into alignment, and adjusted via a sliding adjustment assembly to align the second platform section with the first platform section defined by the sling.

The cab side panels are placed into position on the second platform section, and the cab ceiling is then secured to the tops of the side panels. The cab lighting may be an integral portion of the transom disposed above the operational controls, and thus shipped as part of the modular elevator car package; or, the lighting may be part of the cab ceiling, as desired. The electrical wiring for the car-mounted operational controls is terminated at a receptacle, requiring only that it be connected to a mating plug at the job site.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Concurrently filed application Ser. No. 219,103 entitled "Elevator System" discloses and claims a hydraulic elevator system in which the hydraulic jack extends upwardly through the elevator car within a tunnel, to eliminate, or substantially reduce the depth of a hole for the hydraulic jack. In a preferred embodiment, the car frame is moved to the front of the elevator car and the tunnel is constructed to be the primary vertical structural element of the frame. For purposes of example, the drawings illustrate the tunnel construction, but it is to be understood that the invention applies to any elevator system in which the car frame is located at the front of the car, regardless of whether the hydraulic jack is connected to the bottom of the car frame, or to the top via a tunnel.

Figure 1:
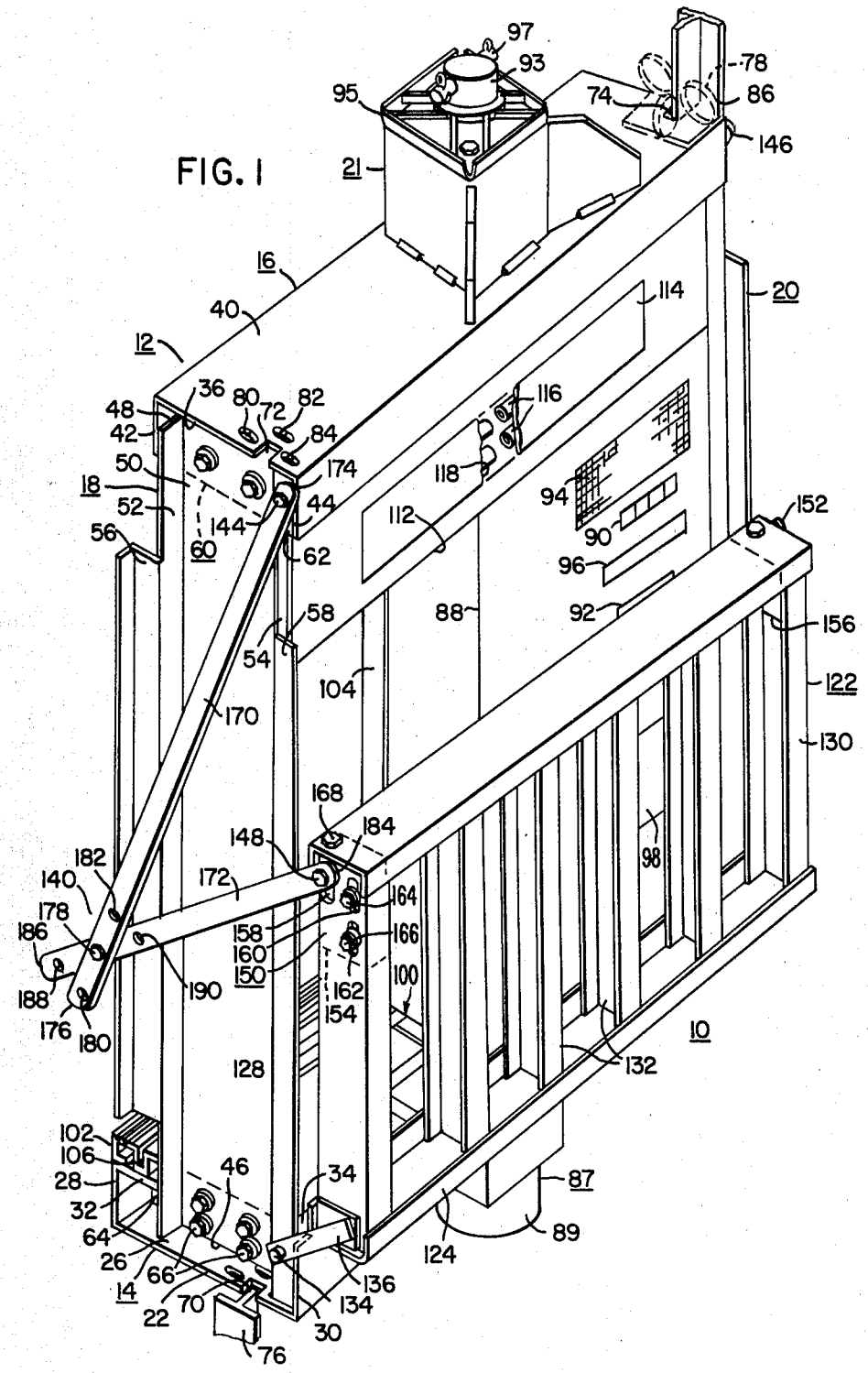
FIG. 1 is a perspective view of a modular elevator car constructed according to the teachings of the invention, with the modular elevator car being illustrated in its shipping configuration.
Figure 2:
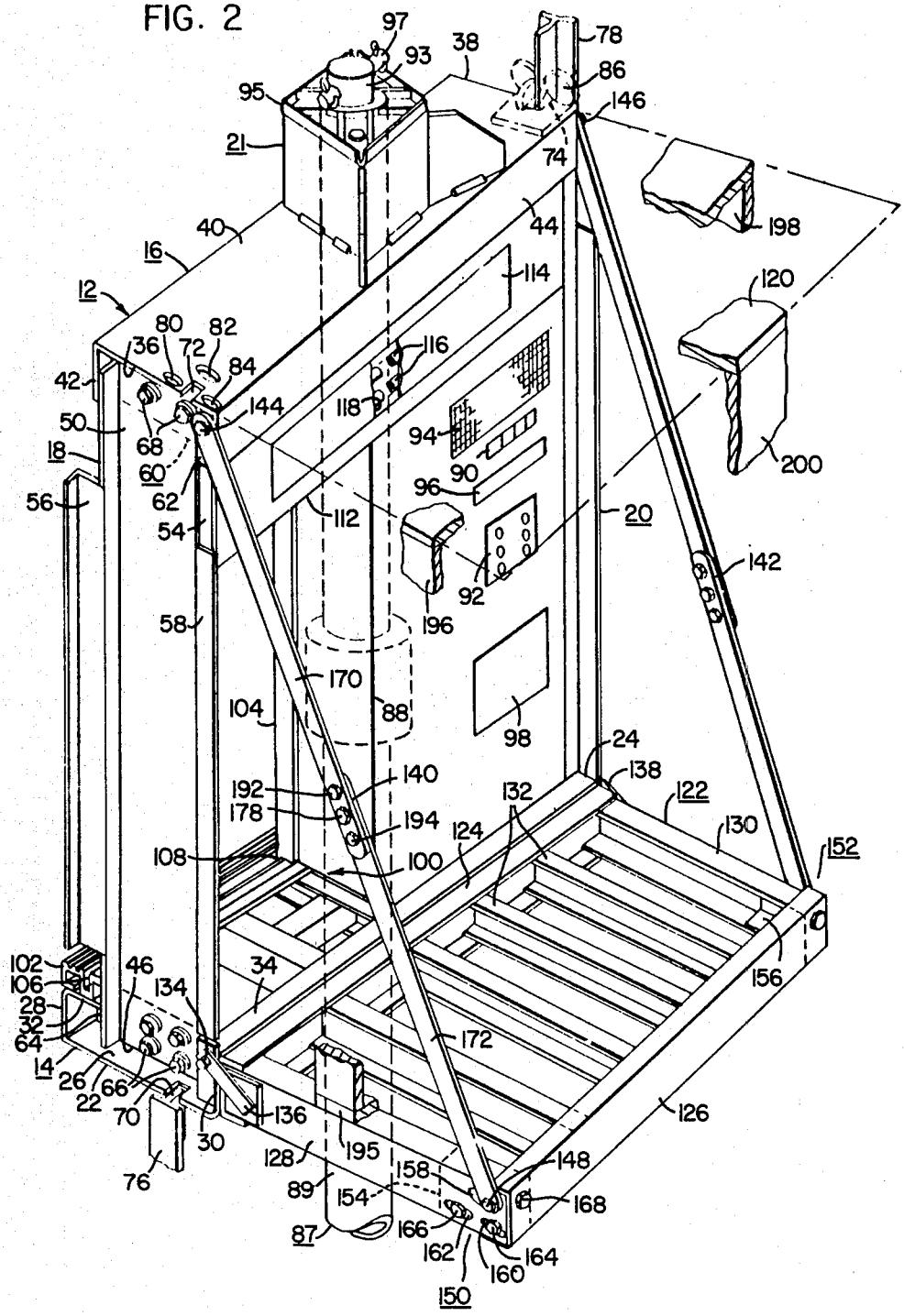
FIG. 2 is a perspective view of the modular elevator car shown in FIG. 1, except in its operational configuration.

Referring now to the drawings, FIGS. 1 and 2 are perspective views of a modular elevator car 10 constructed according to the teachings of the invention. FIG. 1 illustrates modular elevator car 10 in a shipping configuration, and FIG. 2 illustrates car 10 in an operating configuration.

Elevator car 10 includes a car frame or sling 12 which normally is a structural steel rectangular frame oriented such that the longitudinal axis of the frame opening is horizontal. More specifically, sling 12 includes bottom and top beam members 14 and 16, respectively, and first and second upstanding stile members 18 and 20. In the exemplary embodiment illustrated, the car frame 12 also includes a vertically extending tunnel 21. Bottom beam member 14 has first and second ends 22 and 24, respectively, and a substantially U-shaped cross-sectional configuration. The U-shaped configuration includes a bight portion 26, and first and second upstanding leg portions 28 and 30, respectively. The upstanding leg portions 28 and 30 have their ends bent towards one another in a common plane to provide integral, horizontally oriented flanges 32 and 34. The bottom beam member 14 is dimensioned such that the spacing between the upstanding leg portions 28 and 30, and between the aligned ends of flanges 32 and 34, is great enough to provide the complete support for the car-mounted operational controls, to be hereinafter described.

The top beam member 16 has first and second ends 36 and 38, respectively, and it also has a substantially U-shaped cross-sectional configuration, including a bight portion 40 and first and second depending leg portions 42 and 44, respectively.

The upstanding stile members 18 and 20 each have first and second ends, such as first and second ends 46 and 48, respectively, of stile member 18. The stile members, such as stile member 18, have a substantially U-shaped cross-sectional configuration, including a bight portion 50, and first and second leg portions 52 and 54, respectively. The first and second leg portions include integral flanges 56 and 58 at their ends, with the flanges being aligned with one another, but bent in opposite directions.

If tunnel 21 is used, it may be constructed to provide the primary vertical support function, and thus the support provided by the stile members 18 and 20 may be secondary, enabling them to be constructed of relatively thin sheet metal. If tunnel 21 is not used, stile members 18 and 20 would be constructed to provide the primary vertical support function. When stile members 18 and 20 only provide secondary support, substantially Z-shaped mounting brackets are welded between the leg portions of the top beam member 16, one adjacent to each end, to provide mounting points for the second ends of stile members 18 and 20, as well as an anchor and pivot point for foldable braces, to be hereinafter described. For example, a Z-shaped bracket 60 is fixed adjacent to end 36 of top beam member 16, with one leg 62 being visible in the figures.

In like manner, mounting brackets are welded between the leg portions of the bottom beam member 14, such as bracket 64 at the first end 22. As illustrated, suitable nut and bolt assemblies may be used to connect the first ends of the stile members 18 and 20 to the mounting brackets associated with the bottom beam member 14, and the second ends of the stile members 18 and 20 to the mounting brackets associated with the top beam member 16, such as nut and bolt assemblies 66 at the bottom beam member 14, and nut and bolt assemblies 68 at the top beam member 16.

The bottom and top beam members 14 and 16 have slots cut in their bight portions, at their extreme ends, such as slot 70 in end 22 of bottom beam member 14, and slots 72 and 74 in ends 36 and 38, respectively, of top beam member 16, for receiving the nose portion of a guide rail, such as guide rails 76 and 78. The bight portions of the bottom and top beam members 14 and 16 additionally include a plurality of elongated openings adjacent to the guide rail slots for mounting guide roller assemblies, such as openings 80, 82 and 84 adjacent to guide rail slot 72 in the top beam member 16, for receiving a guide roller assembly such as guide roller assembly 86, which is shown in phantom at slot 74.

It will be noted that car frame or sling 12 forms the front portion of the modular elevator car 10, and that the guide rails 76 and 78 will thus be mounted in the forward portion of the associated hatch pit. If tunnel 21 is not used, a conventional bolster plate for receiving the plunger and platen plate of a hydraulic jack would be mounted on the bight 26 of the bottom beam member 14, and thus the hydraulic jack would also be mounted in the forward portion of the associated hatch pit. U.S. Pat. No. 4,041,845, which is assigned to the same assignee as the present application, illustrates the hydraulic cylinder and the normal connection thereof to the elevator car. If tunnel 21 is used, a hydraulic jack 87 having a cylinder 89, cylinder head 91, and at least one plunger 93, would be assembled with the modular elevator car, and shipped therewith. The tunnel 21 includes a removable end plate 95, and an end of plunger 93 extends through an opening in the end plate, and secured with a pin 97.

As hereinbefore stated, the bottom and top beam members, as well as the upstanding stile members, are wide enough to provide a support and enclosure for the car-mounted operational controls. A swing return panel 88, which is hinged to the sling 12, supports and/or encloses the various components which make up the operational controls. For example, a car position indicator 90 indicates the floor position of the elevator car 10, and a car station 92 provides push buttons for selecting destination floors. Additional items may include an exhaust fan disposed behind grillwork 94, an emergency lighting source 96, and a door 98 for gaining access to a telephone. The electrical wiring for the various control components is brought to a common location and terminated at suitable plug-in receptacles conveniently located on modular elevator car 10, facilitating field connection thereto. The operational controls and the swing return 88 occupy only a selected portion of the bottom beam member 14, with the remaining portion 100 defining an entranceway of the elevator car 10, and thus the sling 12 defines a first portion or section 100 of a composite platform assembly, to be hereinafter described.

The horizontally oriented flange 32 of the bottom beam member 14 supports a threshold plate 102 which divides entranceway 100 from the hatch door entrance into the elevator car 10. A car door 104 is mounted for slidable motion to open and close the entranceway, with the threshold plate 102 including a groove 106 for receiving a gib 108 on the bottom edge of the car door 104, for guiding the door. A door operator (not shown) is operably connected to the car door 104, for operating door 104 between its open and closed positions. If tunnel 21 is not used, the door operator may be mounted on the upper surface of the top beam member 16. U.S. Pat. No. 4,043,430, which is assigned to the same assignee as the present application, illustrates a door operator which may be used. Concurrently filed application Ser. No. 219,102, entitled "Elevator System" discloses and claims a door operator suitable for use with an elevator car which uses a tunnel 21. Continuing with the concept of mounting the electrical operational components on sling 12, the normal transom 112 which extends across the inside portion of the elevator car 10, above entranceway 100 and the swing return 88, may be modified to include lighting means 114 for lighting the inside of the cab, such as fluorescent lamps 116 disposed behind a translucent panel 118. Instead of, or in addition to transom lighting, the car top 120, a portion of which is shown in FIG. 2, may include built-in lighting fixtures for providing cab lighting, as desired.

As hereinbefore stated, car sling 12 provides a first section of a composite platform assembly, which section includes portion 100 which defines an entranceway, as well as a portion which supports the swing return 88 and operational controls, including the car station 92, the car door 104, and threshold plate 102. A second platform section 122 completes the composite platform assembly, with the second section 122 being pivotally connected to the sling 12. Platform section 122 is a rectangular structural steel framework having an outer periphery constructed of spaced, parallel front and back beam members 124 and 126, respectively, and first and second side beam members 128 and 130, respectively, which interconnect the front and back beam members, such as by welding. A plurality of intermediate beam members 132 reinforce the outer rectangular framework, by extending in parallel spaced relation between the front and back beam members 124 and 126, respectively.

The pivotal attachment of platform section 122 to sling 12 may include pivot posts attached to stiles 18 and 20, such as pivot post 134 on stile 18, and pivot arm members 136 and 138. Pivot arm members 136 and 138 are welded to the side beams 128 and 130 of platform section 122, with the pivot arm members including openings for receiving pivot post 134. The pivot arm members 136 and 138 are disposed immediately adjacent to the front beam member 124 of platform 122, and the pivot posts are adjacent to the first ends of stiles 18 and 20.

In addition to the pivotal support adjacent to the front beam member 124, foldable braces 140 and 142 extend between sling 12 and platform section 122. Pivot bolts 144 and 146 on the sling 12 provide pivot points for the foldable braces 140 and 142, with the pivot points being disposed near the second ends of stiles 18 and 20. Additional pivot points are provided on platform 122 on side beam members 128 and 130, with these pivot points being adjacent to the back beam member 126, such as provided by pivot bolt 148. Thus, two of the corners of the rectangular framework of platform 122 are pivotally connected to the first ends of the upstanding stile members 18 and 20, and the remaining two corners of platform section 122 are pivotally connected to the second ends of the upstanding stile members 18 and 20.

The pivot points at the remote corners of platform 122 are part of adjustable, slidable assemblies, with pivot pin or bolt 148 being part of an adjustable assembly 150, and with the remaining pivot point at the other corner being part of an adjustable assembly 152. Slidable sleeves 154 and 156 are disposed within the U-shaped cross section of side beam members 128 and 130. Since assemblies 150 and 152 are similar, only assembly 150 will be described in detail. Three tapped openings are provided in a side portion of sleeve 154, with this side portion facing the bight of the associated side beam member 128. A tapped opening is provided in an end portion of sleeve 154, with this end portion of sleeve 154 facing the bight of back beam member 126. Three elongated openings 158, 160 and 162 are provided in the bight of the side beam members, which openings are aligned with the tapped openings in the side portion of sleeve 154. The direction of elongation is parallel with the direction of the longitudinal axis of the associated beam member. An opening in the bight of back beam member 126 is provided, aligned with the tapped opening in the end of sleeve 154. The pivot bolt or pin 148 engages one of the tapped openings via opening 158, and two additional bolts 164 and 166 engage the remaining two tapped openings in the side of sleeve 154 via openings 160 and 162. A bolt 168 engages the tapped opening in the end of sleeve 154 via the opening in the bight of the back beam member 126. Thus, when bolts 148, 164 and 166 are loosened, bolt 168 can move sleeve 154, and thus pivot bolt 148, back and forth, as required to properly align platform section 122 with the platform section of sling 12 which defines the entranceway.

The foldable braces 140 and 142 are similar in construction, and thus only brace 140 will be described in detail. The term "foldable" is meant to broadly cover any selectively collapsible arrangement which will permit platform 122 to swing between, and to maintain, the shipping and operational configurations, and includes telescoping braces as well as those which literally fold. The figures illustrate an exemplary embodiment of the braces, with other arrangements and configurations being suitable. Brace 140 includes first and second elongated bars or sections 170 and 172, respectively. The first section 170 has first and second ends 174 and 176, respectively, with an opening being provided adjacent to the first end 174 for receiving the pivot bolt 144. Three openings are provided in spaced relation adjacent to the second end 176, with the central opening receiving a nut and bolt assembly 178, which also links section 172. The remaining two openings, referenced 180 and 182, are illustrated in FIG. 1.

In like manner, the second section 172 has first and second ends 184 and 186, respectively, with an opening being provided adjacent to the first end 184 for receiving the pivot bolt 148. Three openings are provided in spaced relation adjacent to the second end 186, with the central opening receiving the nut and bolt assembly 178. The remaining two openings, referenced 188 and 190, are illustrated in FIG. 1.

FIG. 1 illustrates the shipping configuration for elevator car 10, with the second platform section 122 being pivoted into a vertical position immediately adjacent to sling 12. Bolts 144, 148 and 178 are tightened to hold platform section 122 in this shipping configuration. This arrangement not only makes a compact shipping package, but it also provides a strong assembly which encloses and protects the operational controls. The sling 12 provides a ring of steel about the controls, the car door 104 encloses one open side of this ring, and platform section 122 partially encloses the remaining open side. Guide rail sections 76 and 78 may also be secured to the shipping assembly, as may be the hatch door and hatch door front for the lowest landing.

When the shipping package shown in FIG. 1 arrives at the job site, it is placed in the hatch pit, the guide rail sections 76 and 78 are secured to the building, the cylinder 87 of the hydraulic jack 89 is attached to the building, and the four guide roller assemblies, such as assembly 86, are adjusted. Thus, the car frame 12 and its associated components are completed supported and properly guided. Bolts 144, 148 and 178 are then loosened and platform section 122 is lowered to the operational position shown in FIG. 2. As illustrated, braces 140 and 142 are unfolded to their aligned configuration, which aligns opening 180 with opening 188, and opening 182 with opening 190. Nut and bolt assemblies 192 and 194 are coupled through these aligned openings and tightened, as is the nut and bolt assembly 178. The adjustable assembly 150 is loosened and bolt 168 is turned in the proper direction to align platform section 122 with the platform section defined by sling 12. When proper alignment is achieved, bolts 144, 148, 162 and 164 are all securely tightened.

Suitable flooring 195 is placed into position on the composite platform. The cab side and back panels are then mounted on flooring 195, such as side panels 196 and 198, and back panel 200. The cab ceiling 120 is then secured to the upper edges of the cab panels, to complete the assembly of the modular elevator car 10.

We claim as our invention:

1. A modular elevator car, comprising:

a car frame including horizontally oriented, vertically spaced top and bottom beam members, and at least one upstanding structural member which extends between and is fixed to said top and bottom beam member, a composite platform assembly for the elevator car including a first platform section defined by the bottom beam of said car frame, and a second platform section, and means pivotally connecting said second platform section to said car frame such that said second platform section is pivotable between a shipping position wherein the second platform section is substantially perpendicular to the first platform section, and an operating position wherein the first and second platform sections cooperatively define the platform assembly of the elevator car, said second platform section defining a rectangular configuration having first and second corners adjacent to the car frame, and third and fourth remote corners, and first and second diagonal braces each having first and second ends, first fastener means fixing their first ends to the car frame, and second fastener means fixing the second ends of the first and second diagonal braces to the second platform section, at its third and fourth corners, respectively, with at least one of the first and second fastener means being adjustable such that the second platform section may be accurately aligned with the first platform section, in the operating position of the second platform section.

2. The elevator car of claim 1 including a cab mounted on and supported by the second platform section, when the second platform section is in its operating position.

3. The elevator car of claim 1 including operating control means, including a car station, said operating control means being disposed on a selected portion of the first platform section, with the remaining portion of the first platform section defining an entranceway to the second platform section.

4. The elevator car of claim 1 wherein the first and second fastener means are pivotable, and the first and second braces are each operable between shipping and operating configurations, enabling the second platform section to pivot between its shipping and operating positions.

5. The elevator car of claim 1 including operating control means, said operating control means being completely supported by the car frame, and at least partially protected by the second platform section when it is in its shipping position.

6. The elevator car of claim 5 wherein the first platform section defines an entranceway, and including a threshold plate adjacent to the entranceway supported by the bottom beam member, and a car door supported by the car frame, said car door being disposed to protect the operating control means when the second platform section is in its shipping position.

7. The elevator car of claim 1 wherein the second fastener means each includes an adjustably slidable sleeve member, with the second end of a diagonal brace being pivotally fixed to said sleeve member.

8. The elevator car of claim 1 wherein the second platform section includes first and second side beam members each having a substantially C-shaped crosssectional configuration, and including first and second sleeve members disposed within the C-shaped crosssectional configuration of said first and second side beam members, adjacent to the third and fourth remote corners, elongated openings in the first and second side beam members, with the second fastener means including means pivotally fixing the second ends of the first and second braces to the first and second sleeve members via an elongated opening, and with the second fastener means further including means adjustably fixing the positions of the first and second sleeve members within the first and second side beam members, to facilitate the alignment of the second platform section with the first.

* * * * *